US006495760B1

(12) United States Patent
Castellani et al.

(10) Patent No.: US 6,495,760 B1
(45) **Date of Patent: *Dec. 17, 2002**

(54) SELF-EXTINGUISHING CABLE WITH LOW-LEVEL PRODUCTION OF FUMES, AND FLAME-RETARDANT COMPOSITION USED THEREIN

(75) Inventors: Luca Castellani, Corsico (IT); Diego Tirelli, Sesto San Giovanni (IT); Franco Peruzzotti, Legnano (IT); Enrico Albizzati, Lesa (IT)

(73) Assignee: Pirelli Cevi e Sistemi S.p.A,, Milan (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/542,545

(22) Filed: Apr. 3, 2000

Related U.S. Application Data

(60) Provisional application No. 60/127,884, filed on Apr. 5, 1999.

(30) Foreign Application Priority Data

Apr. 3, 1999 (EP) ..... 99201109

(51) Int. Cl.[7] ..... H01B 7/00

(52) U.S. Cl. ..... 174/110 R; 174/120 R; 174/121 A; 174/36; 428/500

(58) Field of Search ..... 174/36, 110 R, 174/120 R, 120 SR, 121 R, 121 A; 428/500, 590

(56) References Cited

U.S. PATENT DOCUMENTS

| | | | | |
|---|---|---|---|---|
| 4,317,765 A | | 3/1982 | Gaylord | 523/204 |
| 4,599,391 A | * | 7/1986 | Yamamoto et al. | 526/282 |
| 4,673,620 A | | 6/1987 | Shulman et al. | 428/379 |
| 4,910,359 A | * | 3/1990 | Dougherty et al. | 174/69 |
| 5,162,609 A | * | 11/1992 | Adrianssens et al. | 174/34 |

(List continued on next page.)

FOREIGN PATENT DOCUMENTS

| | | |
|---|---|---|
| DE | 32 28 119 | 2/1984 |
| EP | 0 054 424 | 6/1982 |
| EP | 0 082 407 | 6/1983 |
| EP | 0121594 B1 | 9/1986 |
| EP | 0 274 888 | 7/1988 |

(List continued on next page.)

OTHER PUBLICATIONS

H. Kazuo et al., "Flame–Retarding Olefin Polymer Composition", Abstract of Japanese patent appln. No. 62–058774 Sep. 20, (1988).

*Primary Examiner*—Dean A. Reichard
*Assistant Examiner*—William H. Mayo, III
(74) *Attorney, Agent, or Firm*—Finnegan, Henderson, Farabow, Garrett & Dunner, L.L.P.

(57) ABSTRACT

Cables, in particular electrical cables for low-voltage power transmission or for telecommunications, or alternatively for data transmission or mixed power/telecommunications cables, which have self-extinguishing properties and produce a low level of fumes, wherein a coating layer based on a polymer material and on a flame-retardant inorganic filler is present. The polymer material includes a heterophase copolymer having an elastomeric phase based on ethylene copolymerized with an α-olefin and a thermoplastic phase based on propylene. The elastomeric phase is at least 45% by weight relative to the total weight of the heterophase copolymer and the heterophase copolymer is substantially devoid of crystallinity deriving from polyethylene sequences.

26 Claims, 5 Drawing Sheets

U.S. PATENT DOCUMENTS

| | | | | | |
|---|---|---|---|---|---|
| 5,166,250 | A | | 11/1992 | Breant | 524/437 |
| 5,286,564 | A | | 2/1994 | Cecchin et al. | 428/402 |
| 5,444,809 | A | * | 8/1995 | Aoki et al. | 385/128 |
| 5,525,757 | A | * | 6/1996 | O'Brien | 174/121 A |
| 5,562,957 | A | * | 10/1996 | Hilden | 428/34.7 |
| 5,563,377 | A | * | 10/1996 | Arpin et al. | 174/121 A |
| 5,576,515 | A | * | 11/1996 | Bleich et al. | 174/110 PM |
| 5,643,969 | A | * | 7/1997 | Sakamoto et al. | 521/81 |
| 5,654,095 | A | * | 8/1997 | Yin et al. | 428/372 |
| 5,837,939 | A | * | 11/1998 | Cieloszyk et al. | 174/110 PM |
| 5,841,072 | A | * | 11/1998 | Gagnon | 174/110 F |
| 5,841,073 | A | * | 11/1998 | Randa et al. | 174/113 R |
| 5,889,087 | A | * | 3/1999 | Hayashi et al. | 523/173 |
| 5,919,565 | A | * | 7/1999 | Gross | 428/379 |
| 6,034,162 | A | * | 3/2000 | Mizutani et al. | 524/437 |
| 6,162,548 | A | * | 12/2000 | Castellani et al. | 428/500 |

FOREIGN PATENT DOCUMENTS

| | | |
|---|---|---|
| EP | 0 373 660 | 6/1990 |
| EP | 0 400 333 | 12/1990 |
| EP | 0 448 381 | 9/1991 |
| EP | 0 482 833 | 4/1992 |
| EP | 0 530 940 | 3/1993 |
| GB | 2 190 384 | 11/1987 |
| JP | 63-225641 | 9/1988 |
| WO | WO 96/23311 | 8/1996 |
| WO | WO 99/05688 | 2/1999 |

* cited by examiner

SELF-EXTINGUISHING CABLE WITH LOW-LEVEL PRODUCTION OF FUMES, AND FLAME-RETARDANT COMPOSITION USED THEREIN

CROSS REFERENCE TO RELATED APPLICATIONS

This application is based on European Patent Application No. 99201109.8 filed Apr. 3, 1999 and U.S. Provisional Application No. 60/127,884 filed on Apr. 5, 1999, the content of which is incorporated herein by reference.

BACKGROUND OF THE INVENTION

1. Field of the Invention

The present invention relates to cables, in particular electrical cables for low-voltage power transmission or for telecommunications, or alternatively for data transmission, as well as mixed power/telecommunications cables, which have self-extinguishing properties and produce a low level of fumes, and to flame-retardant compositions used therein.

2. Description of the Related Art

Self-extinguishing cables are generally produced by extruding over the core of the cable a flame-retardant coating consisting of a polymer composition to which flame-retardant properties have been imparted by the addition of a suitable flame-retardant filler of inorganic type, generally a hydroxide, a hydrated oxide or a hydrated salt of a metal, in particular of magnesium or aluminum. The polymer base generally consists of copolymers of ethylene and ethylenically unsaturated esters, in particular ethylene/vinyl acetate or ethylene/ethyl acrylate copolymers, optionally mixed with polyolefins (see for example patents U.S. Pat. No. 4,673,620 and EP-530,940).

Patent application WO 96/23311 describes a low-voltage, high-current cable in which the inner sheath, the insulating coating and the outer sheath consist of the same black-coloured base material and the insulating layer contains a longitudinal coloured stripe for identification purposes. The use of this material for the various layers would not require the separation of the various components in a recycling process. The base material can, depending on the maximum working temperature of the cable, be a polyethylene with a density of between 0.92 and 0.94 g/cm$^3$ and a Shore D hardness $\geqq 42$, or a thermoplastic elastomer based on polypropylene, for example polypropylene modified with an ethylene/propylene copolymer or a polypropylene-based reactor mixture wherein the elastomeric phase content is greater than 25%. When flame-retardant properties are required, it is no longer possible to use the same material for the various coating layers of the cable, and as a polymer base for the layer containing the flame-retardant filler, the use of ethylene/vinyl acetate copolymers or ultra-low-density polyethylene (ULDPE) and, in particular, ethylene-based copolymers obtained with metallocene catalysts is suggested.

On the basis of the Applicant's experience, in order to achieve successful results in the flame-resistant tests commonly carried out on self-extinguishing cables, the amount of flame-retardant filler required is high, generally greater than 30% by weight, usually more than 50% by weight, relative to the total weight of the flame-retardant coating. Such a high level of inorganic filler leads to a deterioration in processability and in mechanical properties of the flame-retardant composition, in particular as regards elongation at break and stress at break. Then, the Applicant has found that, in order to obtain a self-extinguishing cable which satisfies the specifications required by the market, it is necessary to have available a polymer base which is capable of incorporating large amounts of flame-retardant filler and, at the same time, of maintaining good mechanical properties, in particular as regards elongation at break and stress at break.

SUMMARY OF THE INVENTION

The Applicant has now found that it is possible to produce self-extinguishing cables with high flame resistance and excellent mechanical properties by using as flame-retardant coating a mixture of a flame-retardant inorganic filler and a polymer base comprising a heterophase copolymer having an elastomeric phase based on ethylene copolymerized with an α-olefin and a thermoplastic phase based on propylene, wherein the elastomeric phase is at least 45% by weight relative to the total weight of the heterophase copolymer and this copolymer is substantially devoid of crystallinity deriving from polyethylene sequences.

BRIEF DESCRIPTION OF THE SEVERAL VIEWS OF THE DRAWINGS

Further details will be illustrated as follows with reference to the attached figures, wherein.

DETAILED DESCRIPTION OF THE INVENTION

Figure 1:
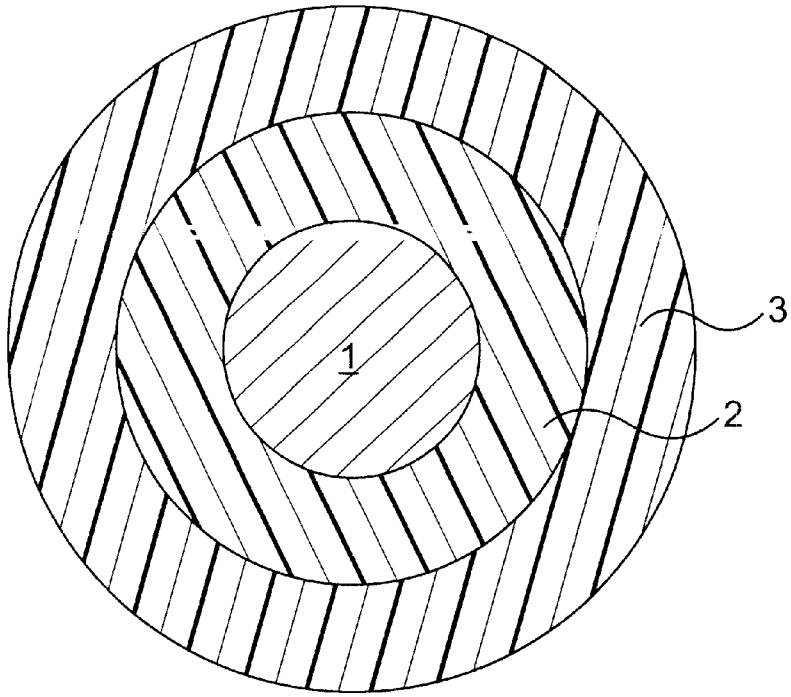
FIG. 1 is a cross-section of a low-voltage electrical cable of unipolar type according to a first embodiment of the present invention.

In a first aspect, the present invention thus relates to a cable comprising at least one conductor and at least one flame-retardant coating layer based on a polymer material and a flame-retardant inorganic filler, characterized in that the said polymer material comprises a heterophase copolymer having an elastomeric phase based on ethylene copolymerized with an α-olefin and a thermoplastic phase based on propylene, the said elastomeric phase in the said heterophase copolymer being at least 45% by weight relative to the total weight of the heterophase copolymer, the said heterophase copolymer being substantially devoid of crystallinity deriving from polyethylene sequences.

According to a first embodiment, the cable has an electrically insulating inner layer and the flame-retardant coating is placed outside the said insulating inner layer.

According to another embodiment, the flame-retardant coating is placed directly on the conductor.

In a second aspect, the present invention relates to a flame-retardant composition based on a polymer material and a flame-retardant inorganic filler, characterized in that the said polymer material comprises a heterophase copolymer having an elastomeric phase based on ethylene copolymerized with an α-olefin and a thermoplastic phase based on propylene, the said elastomeric phase in the said heterophase copolymer being at least 45% by weight relative to the total weight of the heterophase copolymer, the said heterophase copolymer being substantially devoid of crystallinity deriving from polyethylene sequences.

In accordance with the present invention, the use of a heterophase copolymer as described above as a base polymer material makes it possible to obtain self-extinguishing cables which have a flame-retardant coating with an elongation at break (E.B.) value, measured according to CEI standard 20–34 §5.1, of at least 100%, preferably of at least 150%, and a stress at break (S.B.) value, measured according to CEI standard 20–34 §5.1, of at least 6 MPa, preferably of at least 9 MPa.

For the purposes of the present description and of the claims which follow, the expression "heterophase copolymer having an elastomeric phase based on ethylene copolymerized with an α-olefin and a thermoplastic phase based on propylene" means a thermoplastic elastomer obtained by sequential copolymerization of: (a) propylene, optionally containing small amounts of at least one olefin comonomer selected from ethylene and α-olefins other than propylene; and then of: (b) a mixture of ethylene with an α-olefin, in particular propylene and, optionally, with small amounts of a diene. This class of products is also commonly referred to as "thermoplastic reactor elastomers".

For the purposes of the present description and of the claims, the expression "heterophase copolymer substantially devoid of crystallinity deriving from polyethylene sequences" means that the heterophase copolymer, subjected to differential scanning calorimetry (DSC) analysis, shows no appreciable melting peaks attributable to a crystalline polyethylene phase, i.e. to $(CH_2)_n$ sequences of the crystalline type. In quantitative terms, this means that the heat of fusion of peaks present below 130° C. and attributable to polyethylene sequences is generally less than 3 J/g; preferably substantially zero.

Alternatively, the substantial absence of crystallinity due to polyethylene sequences can be ascertained by extracting the elastomeric (amorphous) phase using suitable organic solvents (for example refluxing xylene at 135° C. for 20 min.) and analysing the residue formed by the crystalline phase, for example by X-ray defractometry. The substantial absence of the typical reflection of crystalline polyethylene at the angle $2\theta=21.5°$ (with copper radiation) indicates that the heterophase copolymer is substantially devoid of crystalline polyethylene sequences.

The amount of elastomeric phase present in the heterophase copolymer can be determined according to known techniques, for example by extracting the elastomeric (amorphous) phase with a suitable organic solvent (in particular refluxing xylene at 135° C. for 20 min.): the amount of elastomeric phase is calculated as the difference between the initial weight of the sample and the weight of the dried residue.

The term "α-olefin" means an olefin of formula $CH_2{=}CH{-}R$, wherein R is a linear or branched alkyl containing from 1 to 10 carbon atoms. The α-olefin can be selected, for example, from: propylene, 1-butene, 1-pentene, 1-hexene, 1-octene, 1-dodecene and the like.

The preparation of the heterophase copolymers according to the present invention is usually carried out by copolymerization of the corresponding monomers in the presence of Ziegler-Natta catalysts based on halogenated titanium compounds supported on magnesium chloride. Details regarding the preparation of these copolymers are given, for example, in EP-A-0,400,333, EP-A-0,373,660 and U.S. Pat. No. 5,286,564.

The thermoplastic phase of the heterophase copolymer, mainly produced during the above mentioned step (a) of the process, consists of a propylene homopolymer or a crystalline copolymer of propylene with an olefin comonomer selected from ethylene and α-olefins other than propylene. The olefin comonomer is preferably ethylene. The amount of olefin comonomer is preferably less than 10 mol % relative to the total number of moles of the thermoplastic phase.

As mentioned above, the elastomeric phase of the heterophase copolymer, mainly produced during the above mentioned step (b) of the process, is at least 45% by weight, preferably at least 55% by weight, and even more preferably at least 60% by weight, relative to the total weight of the heterophase copolymer, and consists of an elastomeric copolymer of ethylene with an α-olefin, and optionally with a diene. The said α-olefin is preferably propylene. The diene optionally present as comonomer generally contains from 4 to 20 carbon atoms and is preferably selected from: linear, conjugated or non-conjugated diolefins, for example 1,3-butadiene, 1,4-hexadiene, 1,6-octadiene and the like; monocyclic or polycyclic dienes, for example 1,4-cyclohexadiene, 5-ethylidene-2-norbornene, 5-methylene-2-norbornene and the like. The composition of the elastomeric phase is generally as follows: from 15 to 85 mol % of ethylene, from 15 to 85 mol % of α-olefin, from 0 to 5 mol % of a diene.

In a preferred embodiment, the elastomeric phase consists of an elastomeric copolymer of ethylene and propylene which is rich in propylene units, in particular having the following composition: from 15 to 50% by weight, more preferably from 20 to 40% by weight, of ethylene, and from 50 to 85% by weight, more preferably from 60 to 80% by weight, of propylene, relative to the weight of the elastomeric phase.

The amount of propylene units in the elastomeric phase can be determined by extracting the elastomeric (amorphous) phase using a suitable organic solvent (for example refluxing xylene at 135° C. for 20 min.), followed by analysing the dried extract according to known techniques, for example by infrared (IR) spectroscopy.

Heterophase copolymers with structural properties and related physicochemical properties according to the present invention can be found on the market among the large class of so-called "polypropylene reactor mixtures" sold, for example, by Montell under the brand name Hifax®.

Flame-retardant inorganic fillers which can generally be used are hydroxides, hydrated oxides, salts or hydrated salts of metals, in particular of calcium, aluminium or magnesium, such as, for example: magnesium hydroxide, aluminium hydroxide, alumina trihydrate, magnesium carbonate hydrate, magnesium carbonate, magnesium calcium carbonate hydrate, magnesium calcium carbonate, or mixtures thereof. Magnesium hydroxide, aluminium hydroxide and alumina trihydrate ($Al_2O_3.3H_2O$) and mixtures thereof are particularly preferred. Minor amounts, generally less than 25% by weight, of one or more inorganic oxides or salts such as CoO, $TiO_2$, $Sb_2O_3$, ZnO, $Fe_2O_3$, $CaCO_3$ or mixtures thereof, can advantageously be added to these compounds. The above mentioned metal hydroxides, in particular the magnesium and aluminium hydroxides, are preferably used in the form of particles with sizes which can range between 0.1 and 100 μm, preferably between 0.5 and 10 μm.

One inorganic filler which is particularly preferred according to the present invention is natural magnesium hydroxide. For the purposes of the present invention, the expression "natural magnesium hydroxide" indicates the magnesium hydroxide obtained by milling minerals based on magnesium hydroxide, such as brucite and the like. Brucite is found in nature as such, or, more frequently, in combination with other minerals, such as calcite, aragonite, talc or magnesite, usually in stratified form between silicate deposits, such as, for example, in serpentine, in chlorite or in schists.

Brucite can be milled, according to known techniques, under wet or dry conditions, preferably in the presence of milling coadjuvants, such as polyglycols or the like. The specific surface area of the milled product generally ranges from 5 to 20 $m^2/g$, preferably from 6 to 15 $m^2/g$. The magnesium hydroxide thus obtained can subsequently be classified, for example by sieving, in order to obtain an average particle diameter ranging from 1 to 15 $\mu$m, preferably from 1. 5 to 5 $\mu$m, and a particle size distribution such that the particles with a diameter of less than 1.5 $\mu$m form not more than 10% of the total, and the particles with a diameter of greater than 20 $\mu$m form not more than 10% of the total.

Natural magnesium hydroxide generally contains various impurities deriving from salts, oxides and/or hydroxides of other metals, such as Fe, Mn, Ca, Si, V, etc. The amount and nature of the impurities present can vary as a function of the origin of the starting material. The degree of purity is generally between 80 and 98% by weight. The content of impurities of water-soluble ionic type can be determined indirectly by measuring the electrical conductivity of the aqueous extract obtained by placing the magnesium hydroxide in contact with a suitable amount of water for a predetermined time and at a predetermined temperature according to ISO method 787. According to this method, the electrical conductivity of the aqueous extract obtained from natural magnesium hydroxide is generally between 100 and 500 $\mu$S/cm, preferably between 120 and 350 $\mu$S/cm.

The amount of flame-retardant inorganic filler to be used in the compositions of the present invention is predetermined so as to obtain a cable which is capable of passing the usual flame resistance tests, for example those according to IEC standard 332-1 and IEC 332.3 A, B and C. This amount is generally between 10 and 90% by weight, preferably between 30 and 80% by weight, and even more preferably between 50 and 70% by weight, relative to the total weight of the flame-retardant composition.

The flame-retardant fillers can be used advantageously in the form of coated particles. Coating materials preferably used are saturated or unsaturated fatty acids containing from 8 to 24 carbon atoms, and metal salts thereof, such as, for example: oleic acid, palmitic acid, stearic acid, isostearic acid, lauric acid; magnesium or zinc stearate or oleate; and the like.

A coupling agent selected, for example, from: saturated silane compounds or silane compounds containing at least one ethylenic unsaturation; epoxides containing an ethylenic unsaturation; organic titanates; mono- or dicarboxylic acids containing at least one ethylenic unsaturation, or derivatives thereof such as, for example, anhydrides or esters, can be added to the mixture in order to enhance the compatibility between the inorganic filler and the polymer material. Examples of suitable silane compounds are: $\gamma$-methacryloxy-propyltrimethoxysilane, allyltrimethoxysilane, allyltriethoxysilane, allylmethyidimethoxysilane, allylmethyldiethoxysilane, methyltri-ethoxysilane, methyltris(2-methoxyethoxy)silane, dimethyl-diethoxysilane, vinyltris(2-methoxyethoxy)silane, vinyltrimethoxysilane, vinylmethyld imethoxysilane, vinyltriethoxysilane, octyltriethoxysilane, isobutyltriethoxysilane, isobutyltrimethoxysilane and the like, or mixtures thereof.

Examples of suitable epoxides containing an ethylenic unsaturation are: glycidyl acrylate, glycidyl methacrylate, itaconic acid monoglycidyl ester, maleic acid glycidyl ester, vinyl glycidyl ether, allyl glycidyl ether and the like, or mixtures thereof.

An example of a suitable organic titanate is tetra-n-butyl titanate.

Mono- or dicarboxylic acids containing at least one ethylenic unsaturation, or derivatives thereof, which can be used as coupling agents are, for example: maleic acid, maleic anhydride, fumaric acid, citraconic acid, itaconic acid, acrylic acid, methacrylic acid and the like, and the anhydrides or esters derived therefrom, or mixtures thereof. Maleic anhydride is particularly preferred.

The coupling agents can be used as such or pregrafted onto a polyolefin, for example polyethylene or copolymers of ethylene with an $\alpha$-olefin, by means of a radical reaction (see, for example, patent EP-0,530,940). The amount of grafted coupling agent is generally between 0.05 and 5 parts by weight, preferably from 0.1 to 2 parts by weight, relative to 100 parts by weight of polyolefin. Polyolefins grafted with maleic anhydride are available as commercial products identified, for example, by the brand names Fusabond®, (Du Pont), Orevac® (Elf Atochem), Exxelor® (Exxon Chemical), Yparex® (DSM), etc.

Alternatively, the coupling agents of carboxylic or epoxy type mentioned above (for example maleic anhydride) or silanes containing an ethylenic unsaturation (for example vinyltrimethoxysilane) can be added to the mixture in combination with a radical initiator so as to graft the compatibilizing agent directly onto the polymer material. Initiators which can be used are, for example, organic peroxides such as tert-butyl perbenzoate, dicumyl peroxide, benzoyl peroxide, di-tert-butyl peroxide and the like. This technique is described, for example, in patent U.S. Pat. No. 4,317,765 and in Japanese patent application JP/62-58774.

The amount of coupling agent to be added to the mixture can vary mainly as a function of the type of coupling agent used and the amount of flame-retardant filler added, and is generally between 0.01 and 10%, preferably between 0.02 and 5%, and even more preferably between 0.05 and 2%, by weight relative to the total weight of the base polymer mixture.

Other conventional components, such as antioxidants, processing coadjuvants, lubricants, pigments, other fillers and the like, can be added to the flame-retardant compositions according to the present invention.

Examples of suitable antioxidants are: polymerized trimethyidihydro-quinoline, 4,4'-thiobis(3-methyl-6-tert-butyl)phenol; pentaerythrityl-tetrakis[3-(3,5-di-tert-butyl-4-hydroxyphenyl) propionate], 2,2'-thiodiethylenebis[3-(3,5-di-tert-butyl-4-hydroxyphenyl) propionate] and the like, or mixtures thereof.

Processing coadjuvants usually added to the polymer material are, for example, calcium stearate, zinc stearate, stearic acid, paraffin wax, silicone rubbers and the like, or mixtures thereof.

Other fillers which can be used are, for example: glass particles, glass fibres, calcined kaolin, talc and the like, or mixtures thereof.

The flame-retardant compositions according to the present invention are preferably used in non-crosslinked form, in order to obtain a coating with thermoplastic and thus recyclable properties.

The flame-retardant compositions according to the present invention can be prepared by mixing the polymer component, the filler and the additives according to techniques known in the art. The mixing can be carried out, for example, using an internal mixer of the type with tangential rotors (Banbury) or with interpenetrating rotors, or alternatively in continuous mixers such as Ko-Kneader (Buss) or co-rotating or counter-rotating twin-screw mixers.

The flame-retardant composition can thus be used to coat the conductor directly, or to produce an outer self-extinguishing sheath on the conductor which has been precoated with an insulating layer. The coating step is generally carried out by means of extrusion. When two layers are present, the extrusion can be carried out in two separate steps, extruding the inner layer onto the conductor in a first run and the outer layer onto this inner layer in a second run. The coating process can advantageously be carried out in a single run, for example by means of a "tandem" method, wherein two separate extruders arranged in series are used, or alternatively by co-extrusion using a single extrusion head.

The term "low voltage" generally means a voltage of less than 5 kV, preferably less than 2 kV and even more preferably less than 1 kV.

The cable in FIG. 1 comprises a metal conductor (1), and inner layer (2) which acts as an electrical insulator, and an outer layer (3) which acts as a protective sheath with flame-retardant properties according to the present invention.

The inner layer (2) can consist of a crosslinked or non-crosslinked polymer composition, preferably devoid of halogens, with electrical insulating properties, which is known in the art, selected, for example, from: polyolefins (homopolymers or copolymers of different olefins), olefin/ethylenically unsaturated ester copolymers, polyesters, polyethers, polyether/polyester copolymers and mixtures thereof. Examples of such polymers are: polyethylene (PE), in particular linear low-density PE (LLDPE); polypropylene (PP); propylene/ethylene thermoplastic copolymers; ethylene-propylene rubbers (EPR) or ethylene-propylene-diene rubbers (EPDM); natural rubbers; butyl rubbers; ethylene/vinyl acetate (EVA) copolymers; ethylene/methyl acrylate (EMA) copolymers; ethylene/ethyl acrylate (EEA) copolymers; ethylene/butyl acrylate (EBA) copolymers; ethylene/$\alpha$-olefin copolymers and the like. It is also possible to use the same polymer material for the inner layer (2) as for the outer layer (3).

Figure 2:
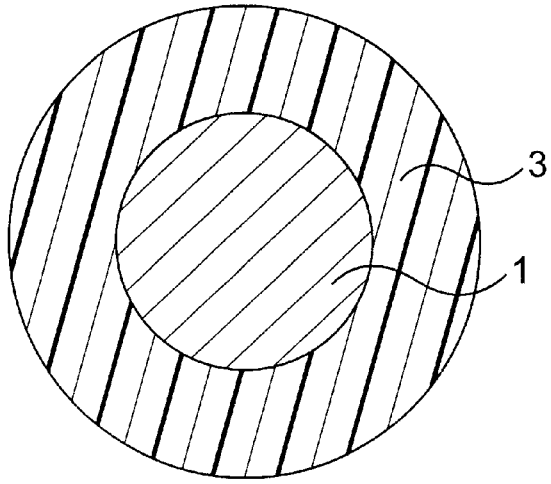
FIG. 2 is a cross-section of a low-voltage electrical cable of unipolar type according to a second embodiment of the present invention.
Figure 3:
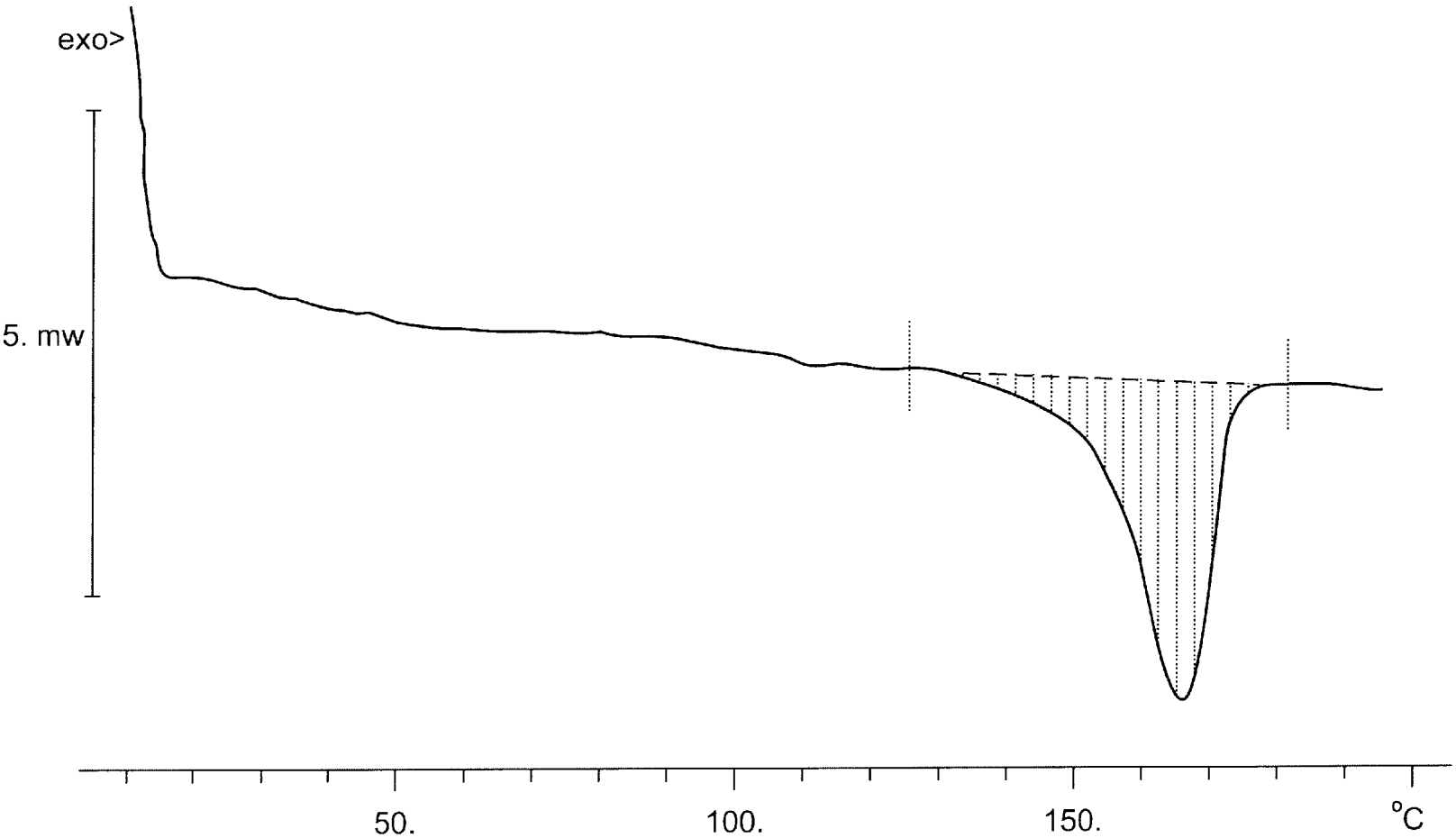
FIGS. 3 and 4 are the DSC curves of two heterophase copolymers according to the present invention (Cop. 1 and 2, respectively)
Figure 4:
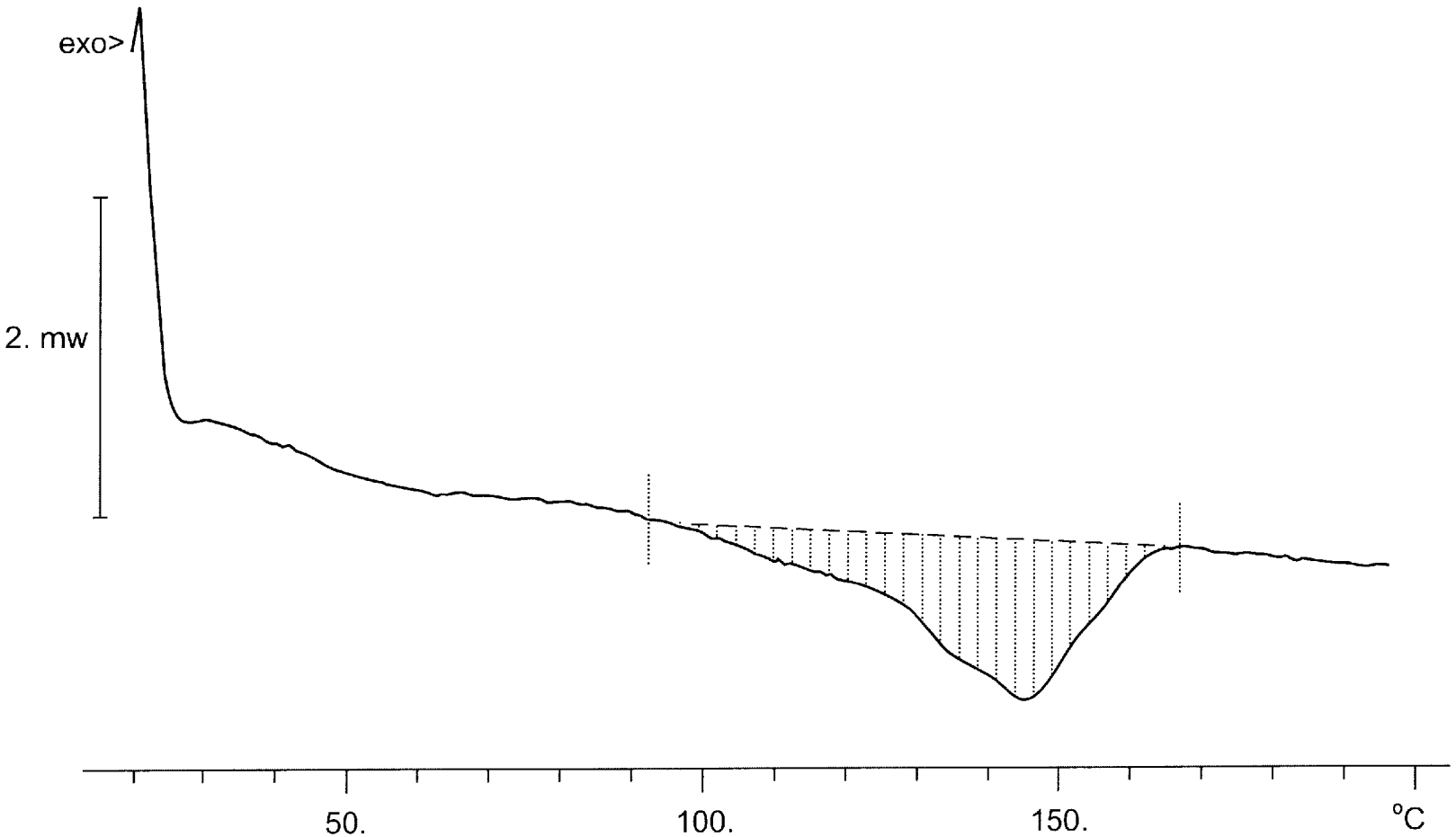
Figure 5:
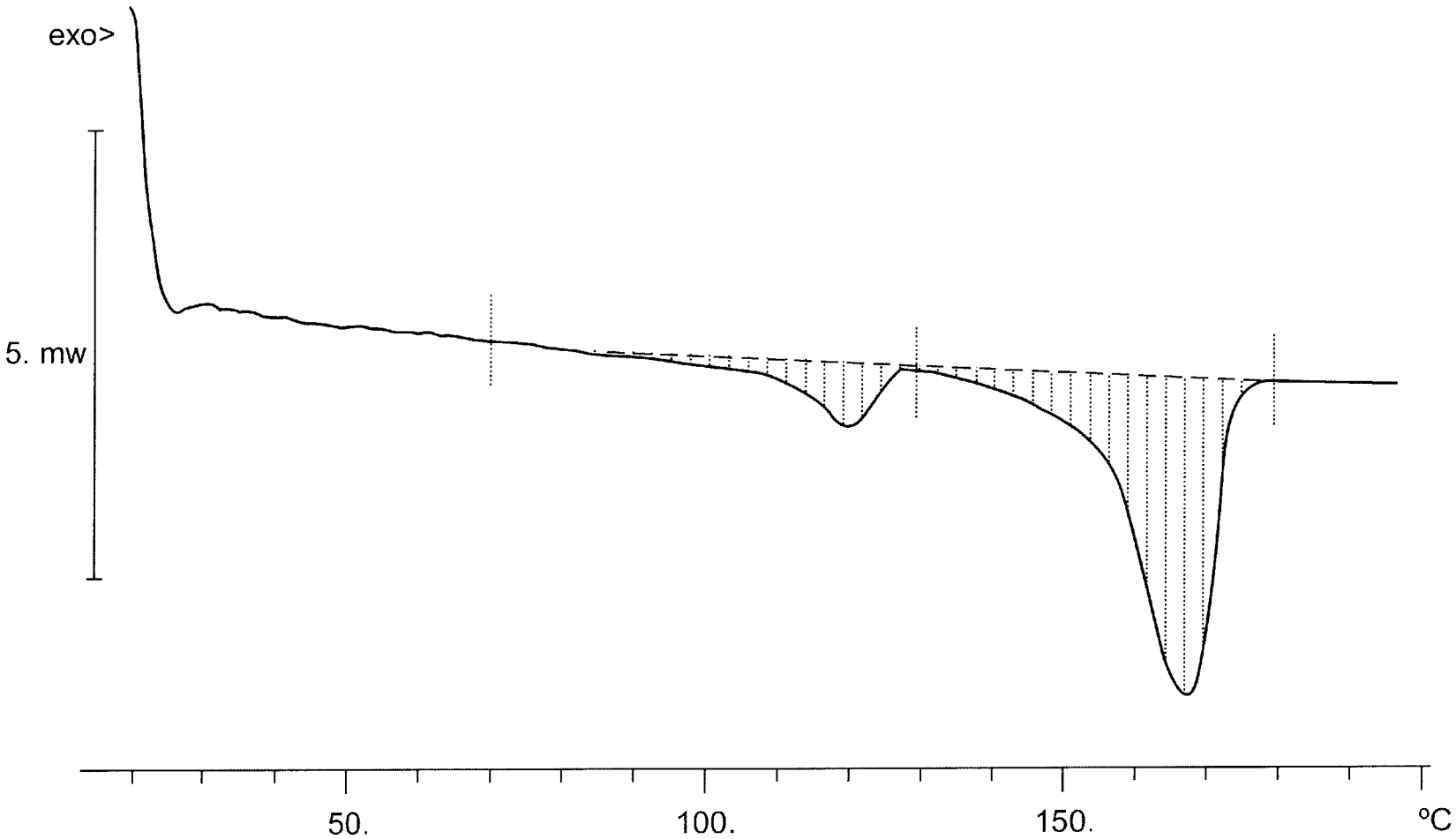
FIGS. 5 and 6 are the DSC curves of two comparative heterophase copolymers (Cop. 3 and 4, respectively).
Figure 6:
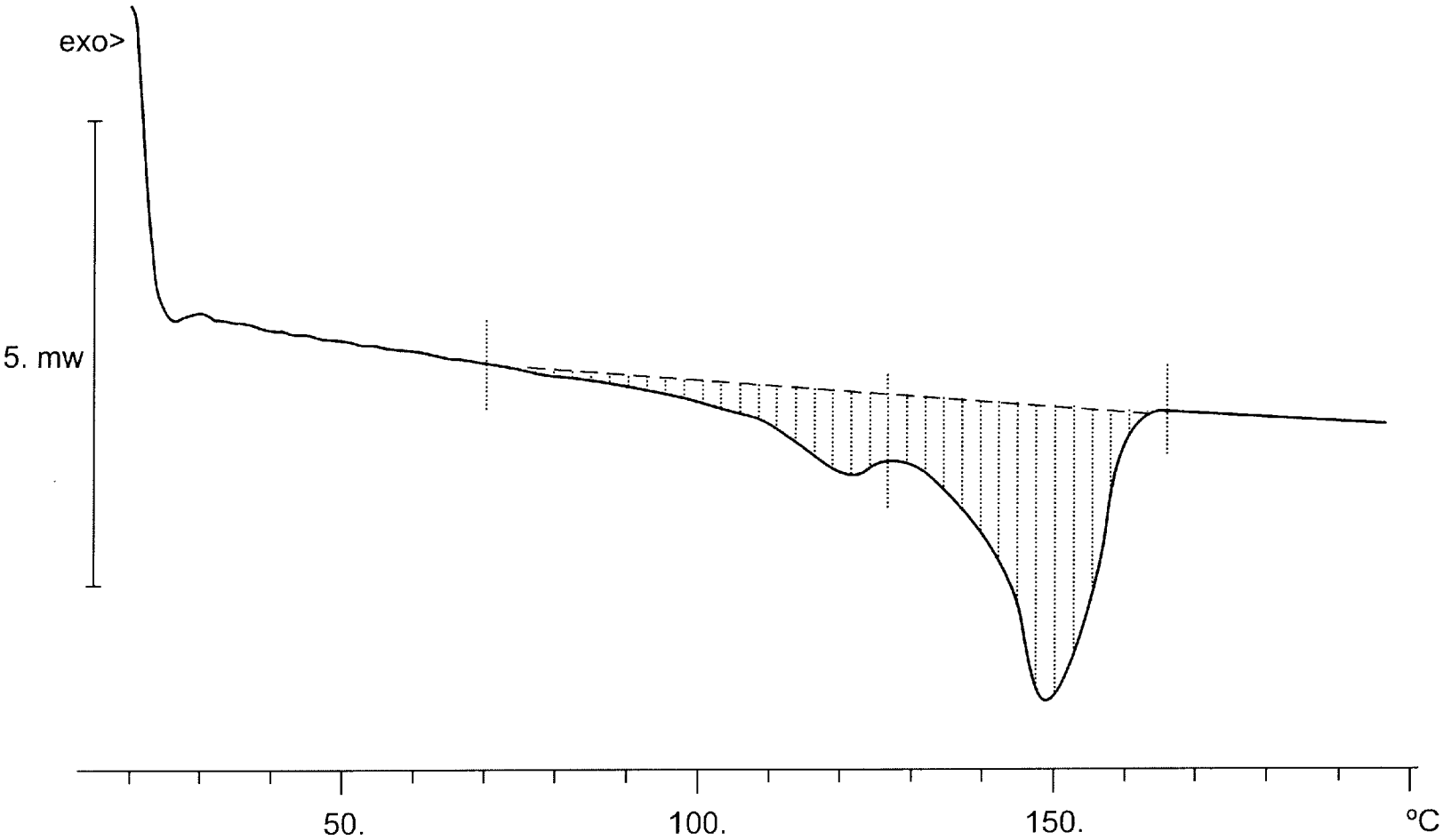

The cable in FIG. 2 comprises a conductor (1) coated directly with a flame-retardant sheath (3) according to the present invention, without interposing the insulating layer (2). In this case, if the conductor (1) is metallic, the self-extinguishing coating (3) also acts as electrical insulation.

A thin polymer layer having an anti-abrasive function, to which a suitable pigment is optionally added in order to produce a coloration for identification purposes, can then be added externally.

FIGS. 1 and 2 show only two possible types of cable according to the present invention. It is clear that suitable modifications known in the art can be made to these embodiments, without thereby departing from the scope of the present invention. In particular, telecommunications cables or data transmission cables, or alternatively mixed power/tele-communications cables, can be produced using the flame-retardant compositions according to the present invention. In addition, although the present description is mainly directed to self-extinguishing cables, the flame-retardant compositions according to the invention can be used to impart self-extinguishing properties to other articles, in particular electrical junction or termination devices.

Table 1 gives a number of properties of some heterophase copolymers used according to the present invention (Cop.1 and Cop. 2) and for comparative purposes (Cop. 3 and Cop. 4).

The melt flow index (MFI) was measured at 230° C. and 21.6 N according to ASTM standard D 1238/L.

The heat of fusion deriving from polypropylene-sequences (PP enthalpy) and the heat of fusion deriving from polyethylene sequences (PE enthalpy) was measured using DSC instrumentation from Mettler (second melting value) with a scanning speed of 10° C./min. (instrument head: DSC 30 type; microprocessor: PC 11 type; software: Mettler Graphware TA72AT.1). The DSC curves of the four heterophase copolymers in Table 1 are given in FIGS. 3–6.

It should be noted that the DSC curve for Cop. 2 shows a single melting peak associated with the polypropylene phase centred at about 145° C., with a very pronounced "tail" which extends below 130° C. and which can be attributed to the presence of a polypropylene phase with low crystallinity presumably consisting of short sequences of propylene units interrupted by ethylene units.

The percentage of elastomeric phase was determined by extraction with refluxing xylene at 135°C. for 20 min., calculated as the difference between the initial weight of the sample and the weight of the dried residue.

The propylene content of the elastomeric phase was determined by IR spectroscopic analysis of the polymer extracted as described above and dried by evaporation of the solvent. The propylene content is determined, by means of suitable calibration curves, as the ratio between the intensity of the bands at 4377 and 4255 $cm^{-1}$.

TABLE 1

| Thermo-plastic elastomer | MFI (dg/min.) | PP en-thalpy (J/g) | PE en-thalpy (J/g) | Elastomeric phase (% by weight) | Propylene in the elastomeric phase (% by weight) |
|---|---|---|---|---|---|
| Cop. 1 | 0.8 | 32.0 | 0 | 60 | 72 |
| Cop. 2 | 0.6 | 23.8 | 0 | 65 | 72 |
| Cop. 3 (*) | 0.9 | 35.4 | 7.3 | 55 | 41 |
| Cop. 4 (*) | 7.5 | 42.8 | 15.4 | 48 | 40 |

(*) comparative
Cop. 1: Hifax ® KS080 from Montell;
Cop. 2: Hifax ® CA10A from Montell;
Cop. 3: Hifax ® CA12A from Montell;
Cop. 4: Hifax ® CA43A from Montell.

The heterophase copolymers in Table 1 were used to prepare the flame-retardant compositions reported in Table 2, using a 1.6 litre Banbury mixer with a volumetric packing ratio of about 75%.

1 mm plates were prepared with the compositions thus obtained by compression moulding at 190–195° C. and 200 bar after preheating for 5 min. at the same temperature. Small cables were then prepared by extruding identical compositions of Table 2 onto a single red copper wire with a cross-section of 1.5 $mm^2$, so as to obtain a 0.7 mm thick flame-retardant layer. The extrusion line speed was 20 m/min, with temperatures in the various zones of the extruder cylinder (diameter =45 mm) of 160–170–190–200° C., the temperature of the extrusion head was 200° C. and that of the ring was 220° C.

The plates and small cables thus prepared were subjected to mechanical tensile strength tests (E.B. and S.B.) according to CEI standard 20-34, paragraph 5.1. The pulling speed of the jaws was 250 mm/min. The cables were also subjected to the flame resistance test according to IEC standard 332-1, which consists in subjecting a sample 60 cm long, placed vertically, to the direct action of a Bunsen burner flame applied for 1 min at an inclination of 45° relative to the sample. All the cable samples passed the test.

TABLE 2

| Example | 1 | 2(*) | 3 | 4 | 5(*) |
|---|---|---|---|---|---|
| Cop. 1 | — | — | 90 | — | — |
| Cop. 2 | 100 | — | — | 90 | — |
| Cop. 3 | — | — | — | — | 90 |
| Cop. 4 | — | 100 | — | — | — |
| Orevac ® CA100 | — | — | 10 | 10 | 10 |
| Hydrofy ® GS1.5 | 160 | 160 | 160 | 160 | 160 |
| Rhodorsil ® MF175U | 0.5 | 0.5 | 0.5 | 0.5 | 0.5 |
| Irganox ® 1010 | 1.5 | 1.5 | 1.5 | 1.5 | 1.5 |
| Mechanical properties on plates | | | | | |
| E. B. (%) | 622 | 32 | 99 | 137 | 24 |
| S. B. (MPa) | 7.2 | 6.5 | 11.6 | 10.5 | 5.7 |
| Mechanical properties on cables | | | | | |
| E. B. (%) | 490 | 38 | 338 | 233 | 17 |
| S. B. (MPa) | 10.1 | 6.3 | 9.0 | 11.1 | 5.0 |

(*)comparative
Orevac ® CA100: polypropylene grafted with maleic anhydride (Elf Atochem) (coupling agent);
Hydrofy ® GS1.5: natural $Mg(OH)_2$ coated with stearic acid (Sima) (average particle diameter 2 microns and specific surface 11 $m^2/g$);
Rhodorsil ® MF175U: silicone rubber (Rhone Poulenc) (processing coadjuvant/lubricant);
Irganox ® 1010: pentaerythrityltetrakis(3,5-di-tert-butyl-4-hydroxyphenyl) propionate (Ciba-Geigy) (antioxidant)

The data given in Table 2 show that the cables and compositions according to the present invention have excellent mechanical properties, fully satisfying the specifications, despite the fact that they have a high content (61%) of inorganic filler.

What is claimed is:

1. Cable comprising at least one conductor and at least one flame-retardant coating layer based on a polymer material and a flame-retardant inorganic filler, characterized in that said polymer material comprises a heterophase copolymer having an elastomeric phase comprising ethylene copolymerized with an α-olefin and a thermoplastic phase based on propylene, said elastomeric phase in said heterophase copolymer being at least 45% by weight relative to the total weight of the heterophase copolymer, said heterophase copolymer being substantially devoid of crystallinity deriving from polyethylene sequences wherein said heterophase copolymer has a heat of fusion of peaks present below 130° C. and attributable to polyethylene sequences of less than 3 J/g.

2. Cable according to claim 1, wherein an electrically insulating inner layer is present and the flame-retardant coating layer is placed outside said insulating inner layer.

3. Cable according to claim 1, wherein said at least one flame-retardant coating is placed directly on said at least one conductor.

4. Cable according to claim 1 wherein said heterophase copolymer has a heat of fusion of peaks present below 130° C. and attributable to polyethylene sequences which is substantially zero.

5. Cable according to claim 1, wherein said elastomeric phase consists of an elastomeric copolymer comprising from 15 to 50% by weight of ethylene and from 50 to 85% by weight of propylene, relative to the weight of the elastomeric phase.

6. Cable according to claim 5, wherein said elastomeric phase consists of an elastomeric copolymer comprising from 20 to 40% by weight of ethylene and from 60 to 80% by weight of propylene, relative to the weight of the elastomeric phase.

7. Cable according to claim 1, wherein the flame-retardant inorganic filler is a hydroxide, hydrated oxide, salt or hydrated salt of metals, or mixtures thereof.

8. Cable according to claim 7, wherein the flame-retardant inorganic filler is magnesium hydroxide, alumina trihydrate, or mixtures thereof.

9. Cable according to claim 8, wherein the flame-retardent inorganic filler is natural magnesium hydroxide.

10. Cable according to claim 1, wherein the flame-retardant inorganic filler is present in an amount of between 10 and 90% by weight relative to the total weight of the flame-retardant layer.

11. Cable according to claim 10, wherein the flame-retardant inorganic filler is present in an amount of between 30 and 80% by weight relative to the total weight of the flame-retardant layer.

12. Cable according to claim 11, wherein the flame-retardant inorganic filler is present in an amount of between 50 and 70% by weight relative to the total weight of the flame-retardant layer.

13. The cable of claim 1 wherein said heterophase copolymer includes small amounts of a diene having from 4 to 20 carbon atoms selected from linear, conjugated or non-conjugated diolefins, or monocyclic or polycyclic dienes.

14. The cable of claim 13 wherein said diene is selected from 1,3-butadiene, 1,4-hexadiene, 1,6-octadiene, 1,4-cyclohexadiene, 5-ethylidene-2-norbornene, and 5-methylene-2-norbornene.

15. Flame retardant composition based on a polymer material and a flame-retardant inorganic filler, characterized in that said polymer material comprises a heterophase copolymer having an elastomeric phase based on ethylene copolymerized with an α-olefin and a thermoplastic phase comprising propylene, said elastomeric phase in said heterophase copolymer being at least 45% by weight relative to the total weight of the heterophase copolymer, said heterophase copolymer being substantially devoid of crystallinity deriving from polyethylene sequences wherein said heterophase copolymer has a heat of fusion of peaks present below 130° C. and attributable to polyethylene sequences of less than 3 J/g.

16. Composition according to claim 15, wherein the flame-retardant inorganic filler is a hydroxide, hydrated oxide salt or hydrated salt of metals, or mixtures thereof.

17. Composition according to claim 15, wherein said heterophase copolymer has a heat of fusion of peaks present below 130° C. and is attributable to polyethylene sequences which is substantially zero.

18. Composition according to claim 15, wherein said elastomeric phase consists of an elastomeric copolymer comprising from 15 to 50% by weight of ethylene and from 50 to 85% by weight of propylene, relative to the weight of the elastomeric phase.

19. Composition according to claim 18, wherein said elastomeric phase consists of an elastomeric copolymer comprising from 20 to 40% by weight of ethylene and from 60 to 80% by weight of propylene, relative to the weight of the elastomeric phase.

20. Composition according to claim 15, wherein the flame-retardant inorganic filler is magnesium hydroxide, alumina trihydrate, or mixtures thereof.

21. Composition according to claim 20, wherein the flame-retardant inorganic filler is natural magnesium hydroxide.

22. Composition according to claim 15, wherein the flame-retardant inorganic filler is present in an amount of between 10 and 90% by weight relative to the total weight of the flame-retardant layer.

23. Composition according to claim 22, wherein the flame-retardant inorganic filler is present in an amount of between 30 and 80% by weight relative to the total weight of the flame-retardant layer.

24. Composition according to claim 23, wherein the flame-retardant inorganic filler is present in an amount of between 50 and 70% by weight relative to the total weight of the flame-retardant layer.

25. The composition of claim 24 wherein said heterophase copolymer includes small amounts of a diene having from 4 to 20 carbon atoms selected from linear, conjugated or non-conjugated diolefins, or monocyclic or polycyclic dienes.

26. The composition of claim 25 wherein said diene is selected from 1,3-butadiene, 1,4-hexadiene, 1,6-octadiene, 1,4-cyclohexadiene, 5-ethylidene-2-norbornene, and 5-methylene-2-norbornene.

* * * * *

UNITED STATES PATENT AND TRADEMARK OFFICE

CERTIFICATE OF CORRECTION

PATENT NO. : 6,495,760 B1
DATED : December 17, 2002
INVENTOR(S) : Luca Castellani et al.

It is certified that error appears in the above-identified patent and that said Letters Patent is hereby corrected as shown below:

Title page,
Item [73], Assignee, "Cevi" should read -- Cavi --; and "S.p.A,," should read -- S.p.A., --

Column 10,
Line 7, "flame-retardent" should read -- flame-retardant --.
Line 43, after "oxide", insert a comma Signed and Sealed this Third Day of June, 2003

JAMES E. ROGAN
*Director of the United States Patent and Trademark Office*